US009999571B2

(12) United States Patent
Ding et al.

(10) Patent No.: US 9,999,571 B2
(45) Date of Patent: Jun. 19, 2018

(54) UNIFORM-DISTRIBUTION FILLING MECHANISM FOR MEDICINAL POWDER

(71) Applicant: ZHEJIANG HUASHILI MACHINERY CO., LTD., Ruian (CN)

(72) Inventors: Jin Jin Ding, Ruian (CN); Jie Su, Ruian (CN); Jun Yong Ying, Ruian (CN); Hong Su, Ruian (CN); Jun Guo Li, Ruian (CN); Xu Zhan Chen, Ruian (CN); Yi Xing Huang, Ruian (CN)

(73) Assignee: ZHEJIANG HUASHILI MACHINERY CO., LTD., Ruian (CN)

( * ) Notice: Subject to any disclaimer, the term of this patent is extended or adjusted under 35 U.S.C. 154(b) by 95 days.

(21) Appl. No.: 15/028,938

(22) PCT Filed: Oct. 17, 2014

(86) PCT No.: PCT/CN2014/088817

§ 371 (c)(1),
(2) Date: Apr. 12, 2016

(87) PCT Pub. No.: WO2015/055138

PCT Pub. Date: Apr. 23, 2015

(65) Prior Publication Data

US 2016/0256354 A1 Sep. 8, 2016

(30) Foreign Application Priority Data

Oct. 17, 2013 (CN) ..... 2013 1 0511450

(51) Int. Cl.
*A61J 3/07* (2006.01)
*B65B 1/10* (2006.01)

(52) U.S. Cl.
CPC ..... *A61J 3/074* (2013.01); *B65B 1/10* (2013.01)

(58) Field of Classification Search
CPC ..... B65B 1/10; A61J 3/074
(Continued)

(56) References Cited

U.S. PATENT DOCUMENTS 1,819,936 A * 8/1931 Wilkie ..... A61J 3/074 141/133
2,646,912 A * 7/1953 Reveno ..... A61J 3/075 141/12

(Continued)

*Primary Examiner* — Timothy L Maust
(74) *Attorney, Agent, or Firm* — Raymond Y. Chan; David and Raymond Patent Firm

(57) ABSTRACT

A uniform-distribution filling mechanism for medicinal powder includes a metering disk, a powder storage ring, and a lateral powder blocker. One end of the blocker is provided with a pointed tip, and the other end thereof is provided with a sloping stage. The middle portion of the metering disk is provided with a support shaft, said shaft and the blocker being connected one to the other by means of a support arm. Medicinal powder enters via the pointed tip of the blocker, is evenly agitated, exits via the sloping stage of the blocker, and is evenly dispensed. Thus, the powder is able to enter one side of the blocker and come out the other side thereof such that the powder is evenly dispensed and then uniformly distributed onto the metering disk. This ensures that powder holes of a same group on the metering disk are filled with medicinal powder uniformly and with precision, thereby ensuring that capsules are filled uniformly and consistently with medicinal powder, thus increasing the success rate when filling capsules.

33 Claims, 6 Drawing Sheets

(58) Field of Classification Search
USPC ..... 141/125, 144–148
See application file for complete search history.

(56) References Cited

U.S. PATENT DOCUMENTS

| | | | | | |
|---|---|---|---|---|---|
| 2,655,301 | A * | 10/1953 | Riemer | B65B 1/28 | 141/93 |
| 3,055,403 | A * | 9/1962 | Barresi | B65B 1/28 | 141/284 |
| 3,269,429 | A * | 8/1966 | Fritts | A61J 3/075 | 141/133 |
| 3,921,681 | A * | 11/1975 | Rebmann | A61J 3/074 | 141/258 |
| 4,865,092 | A * | 9/1989 | Reichelt | G01F 11/24 | 141/129 |
| 5,320,146 | A * | 6/1994 | Stevie | B65B 1/363 | 141/1 |
| 5,549,144 | A * | 8/1996 | Dworak | B65B 1/24 | 141/10 |
| 5,855,233 | A * | 1/1999 | Bolelli | A61J 3/074 | 141/103 |
| 6,050,308 | A * | 4/2000 | Wurst | A61J 3/074 | 141/146 |
| 6,098,675 | A * | 8/2000 | Runft | B65B 1/363 | 141/71 |
| 6,814,111 | B1 * | 11/2004 | Oliverio | B65B 9/087 | 141/1 |
| 7,661,447 | B2 * | 2/2010 | Bailey | B65B 1/363 | 141/12 |
| 8,307,860 | B2 * | 11/2012 | Schlipf | A61J 3/074 | 141/125 |
| 8,720,497 | B2 * | 5/2014 | Meckstroth | B65B 1/08 | 141/72 |
| 2006/0174966 | A1 * | 8/2006 | Facchini | B65B 37/02 | 141/67 |
| 2008/0190516 | A1 * | 8/2008 | Arvidsson | B65B 1/36 | 141/237 |
| 2011/0139812 | A1 * | 6/2011 | Dagsland | B65B 1/363 | 141/237 |
| 2011/0284573 | A1 * | 11/2011 | Dagsland | B65B 1/06 | 141/237 |
| 2012/0048422 | A1 * | 3/2012 | Dagsland | B65B 1/363 | 141/12 |

* cited by examiner

UNIFORM-DISTRIBUTION FILLING MECHANISM FOR MEDICINAL POWDER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a capsule filling machine, specifically to a filling mechanism applied to capsule filling machine.

Description of Related Arts

Currently, the pharmaceutical industry uses fully-automatic type capsule filling machine, including a capsule sorting and splitting mechanism, an empty capsule eliminating mechanism, filling mechanism and refilling mechanism, capsule securing mechanism, product ejecting mechanism, mold cleaning mechanism, man-machine interface controlling mechanism, mechanical driving mechanism, index tabling mechanism, and framework, working platform, and etc.

Among these, the working principles of filling mechanism is to have medicinal powder evolved to a powder grain shape through multiple times or series of progressive stamping, and to fill the medicinal powder into vacant capsule bodies, whereby in this procedure of stamping medicinal powder to form powder grain, the medicinal powder has to pass through the blocking of a flat head lateral powder blocker at a side of the metering disk, which causes an amount of medicinal powder unevenly transported and not uniformly distributed, causing the amount of medicinal powder to differ among various medicinal powder holes of the same set on the metering disk and to have less precision, resulting in less precision in the filling of the medicinal powder into the capsule, diminished yield rate of capsule products, and further causing less effective treatment for patients.

SUMMARY OF THE PRESENT INVENTION

I. Technical Issues to be Solved by the Present Invention

An object of the present invention is to overcome the above disadvantages and to provide a uniform-distribution filling mechanism for medicinal powder which may allow the medicinal powder to be transported evenly and uniformly distributed on the metering disk.

II. Technical Solution Applied by the Present Invention

Another object of the present invention is implemented through the following technical solution: an uniform-distribution filling mechanism for medicinal powder, including a metering disk, a powder storage ring and a lateral powder blocker, wherein an end of the lateral powder blocker has a pointed tip, and the other end of the lateral powder blocker has a downhill sloping stage, wherein a middle part of the metering disk has a support shaft mounted thereon, and the support shaft connects to the lateral powder blocker through a support arm.

In order to accomplish the above objects, the present invention provides an uniform-distribution filling mechanism for a medicinal powder, which is adapted for a capsule filling machine, comprising:

a metering disk;

a powder storage ring having a containing chamber for storing medicinal powder, wherein the metering disk is contained in the containing chamber; and a lateral powder blocker, wherein the lateral powder blocker extends from one side of the powder storage ring to another side thereof and the lateral powder blocker is axially connected to the metering disk.

According to one embodiment of the present invention, the lateral powder blocker has a pointed tip adapted for stirring medicinal powder evenly and a sloping stage adapted for uniformly distributing medicinal powder on the metering disk, wherein the pointed tip and the sloping stage are respectively provided at two sides of the lateral powder blocker.

According to one embodiment of the present invention, the lateral powder blocker includes an upper lateral powder blocker and a lower lateral powder blocker overlappingly set at the upper lateral powder blocker, wherein each of the upper lateral powder blocker and the lower lateral powder blocker a pointed tip at the same side thereof, wherein the other end of the upper lateral powder blocker forms a platform while, correspondingly, the other end of the lower lateral powder blocker forms a sloping stage.

According to one embodiment of the present invention, the sloping stage is a downhill form sloping stage.

According to one embodiment of the present invention, a support arm and a support shaft are also included, wherein the support shaft is axially connected to the metering disk, wherein two ends of the support arm are respectively connected to the support shaft and the lateral powder blocker, so as to allow the lateral powder blocker to use the support shaft as an axis to conduct rotational movement toward the metering disk.

According to one embodiment of the present invention, a bearing housing is also included and is set at the metering disk, wherein the support shaft is set and axially connected to the bearing housing.

According to one embodiment of the present invention, a middle powder blocker is also included and it is set at the bearing housing.

The present invention also provides a capsule filling machine, which includes:

a filling machine body, which includes a main driving part; and an uniform-distribution filling mechanism for medicinal powder, which further includes:

a metering disk;

a powder storage ring having a containing chamber for storing medicinal powder, wherein the metering disk is contained in the containing chamber; and a lateral powder blocker, wherein the lateral powder blocker extends from one side of the powder storage ring to another side thereof and the lateral powder blocker is axially connected to the metering disk, wherein the lateral powder blocker is coupled to the main driving part, so as to synchronize with the movement of the main driving part.

According to one embodiment of the present invention, the lateral powder blocker has a pointed tip for stirring medicinal powder evenly and a sloping stage for uniformly distributing medicinal powder on the metering disk, wherein the pointed tip and the sloping stage are respectively provided at the two sides of the lateral powder blocker.

According to an embodiment of the present invention, the lateral powder blocker includes an upper lateral powder blocker and a lower lateral powder blocker overlappingly set at the upper lateral powder blocker, wherein each of the upper lateral powder blocker and the lower lateral powder blocker has a pointed tip at the same side thereof, wherein the other end of the upper lateral powder blocker forms a platform while, correspondingly, the other end of the lower lateral powder blocker forms a sloping stage.

According to one embodiment of the present invention, the sloping stage is a downhill form sloping stage.

According to one embodiment of the present invention, a support arm and a support shaft are also included, wherein the support shaft is axially connected to the metering disk, wherein two ends of the support arm are respectively connected to the support shaft and the lateral powder blocker, so as to allow the lateral powder blocker to use the support shaft as an axis to conduct rotational movement toward the metering disk.

According to one embodiment of the present invention, a bearing housing is also included and set at the metering disk, wherein the support shaft is set and axially connected to the bearing housing.

According to one embodiment of the present invention, a middle powder blocker is also included and it is set at the bearing housing.

According to one embodiment of the present invention, a guide plate is also included, wherein the guide plate has a guide channel, so that the support arm is allowed to pass through the guide channel.

According to one embodiment of the present invention, the main driving part is a stepper motor.

The present invention also provides a method to implement evenly filling medicinal powder into capsules, wherein the method includes the following steps:

(a) securing capsules; and (b) driving a lateral powder blocker that is axially connected to a side of a metering disk for stirring and evenly transferring medicinal powder to fill into the capsules.

According to one embodiment of the present invention, the step (b) further includes the following steps:

(b.1) axially connecting one the lateral powder blocker to the metering disk;

(b.2) providing a powder storage ring for storing medicinal powder, wherein the lateral powder blocker extends from one side of the powder storage ring to another side thereof; and (b.3) driving the lateral powder blocker to move relative to the metering disk to respectively stir and transfer medicinal powder evenly.

According to one embodiment of the present invention, the lateral powder blocker has a pointed tip and a sloping stage, wherein the pointed tip and the sloping stage are respectively provided at the two sides of the lateral powder blocker, wherein the pointed tip is for stirring medicinal powder evenly, wherein the sloping stage is for uniformly distributing medicinal powder on the metering disk.

According to one embodiment of the present invention, the lateral powder blocker includes an upper lateral powder blocker and a lower lateral powder blocker overlappingly set at the upper lateral powder blocker, wherein each of the upper lateral powder blocker and the lower lateral powder blocker has a pointed tip at the same side thereof, wherein the other end of the upper lateral powder blocker forms a platform while, correspondingly, the other end of the lower lateral powder blocker forms a sloping stage.

According to one embodiment of the present invention, a support arm and a support shaft are also included, wherein the support shaft is axially connected to the metering disk, wherein two ends of the support arm are respectively connected to the support shaft and the lateral powder blocker, so as to allow the lateral powder blocker to use the support shaft as an axis to conduct rotational movement toward the metering disk.

According to one embodiment of the present invention, a bearing housing is also included and set at the metering disk, wherein the support shaft is set and axially connected to the bearing housing.

III. Benefits of the Present Invention

Benefits of the present invention include:

A major advantage of the present invention is to provide a uniform-distribution filling mechanism for medicinal powder, wherein that uniform-distribution filling mechanism for medicinal powder is able to evenly fill medicinal powder into capsules, so as to increase the effect of the capsule in treating diseases.

Through the present invention, the mass of medicinal powder in the metering disk and the powder storage ring will be through the insertion by the pointed tip of the lateral powder blocker and the effect of evenly stirring of the medicinal powder by the lateral powder blocker itself. Then, the medicinal powder will be evenly transferred downward through a downhill form sloping stage of the lateral powder blocker, so that the medicinal powder is able to be evenly transferred and proportionately distributed on the metering disk by entering to a side of the lateral powder blocker and leaving from the other side thereof. The medicinal powder, in various sets of medicinal powder holes, is then progressively stamped for several times by filling sticks of the capsule filling machine, so as to conform the amount of medicinal powder in each set of the medicinal powder holes on the metering disk, which increases the precision, conformity and unifies the filled amount of medicinal powder for each capsule. The yield rate of capsule filling is also raised.

These and other advantages, features, and objectives of the current invention will be shown in the following detail description, drawing, and appended claims.

DETAILED DESCRIPTION OF THE PREFERRED EMBODIMENT

In order that those skilled in the art can further understand the present invention, a detailed description will be provided in the following. However, these descriptions and the appended drawings are only used to cause those skilled in the art to understand the objects, features, and characteristics of the present invention, but not to be used to confine the scope and spirit of the present invention defined in the appended claims.

Figure 1:
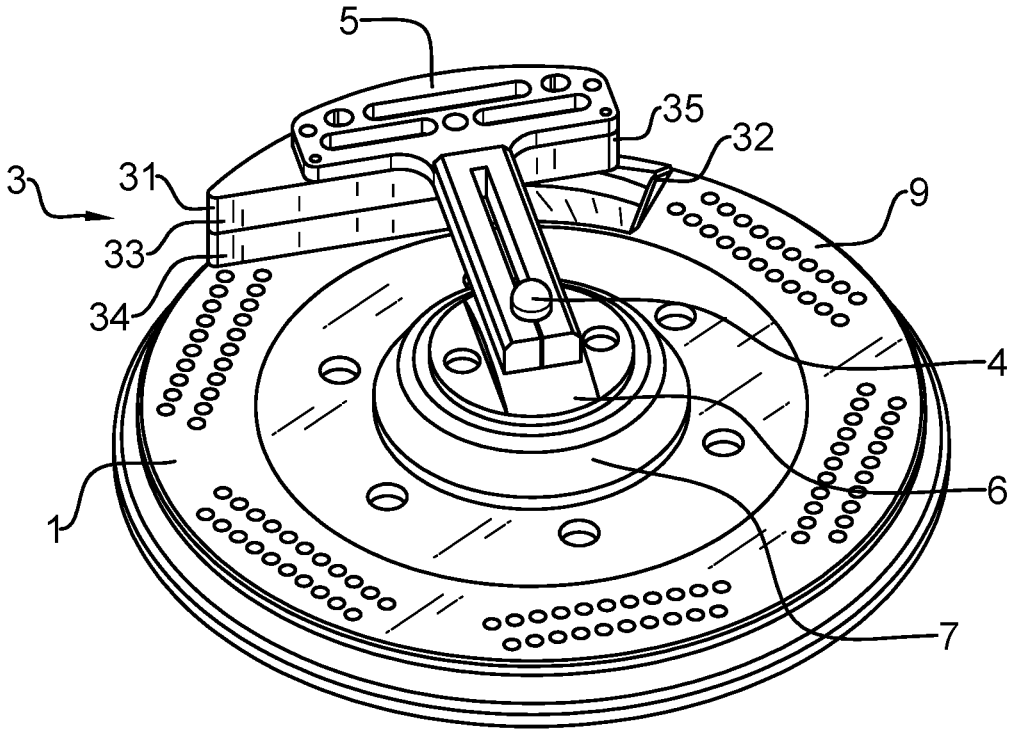
FIG. 1 is a structural schematic diagram of a uniform-distribution filling mechanism for a medicinal powder (without powder storage ring) of the present invention.
Figure 2:
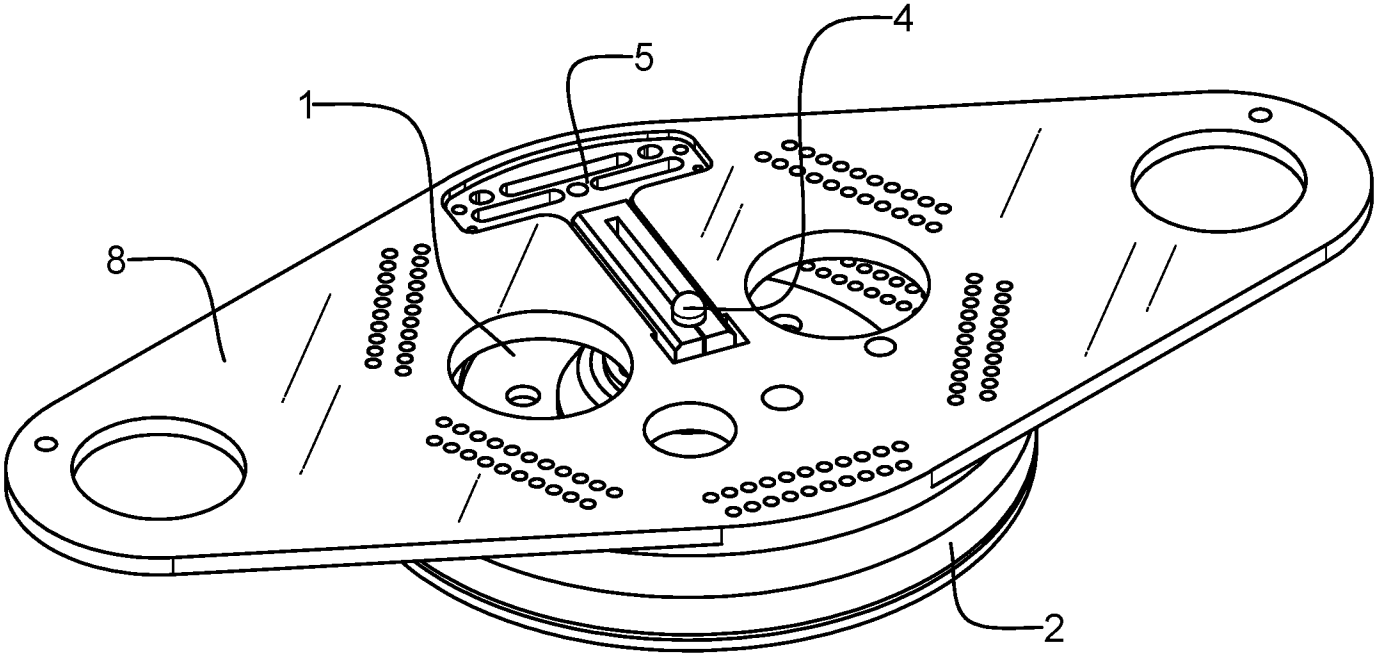
FIG. 2 is an installation schematic diagram having guide plate and powder storage ring added to FIG. 1.
Figure 3:
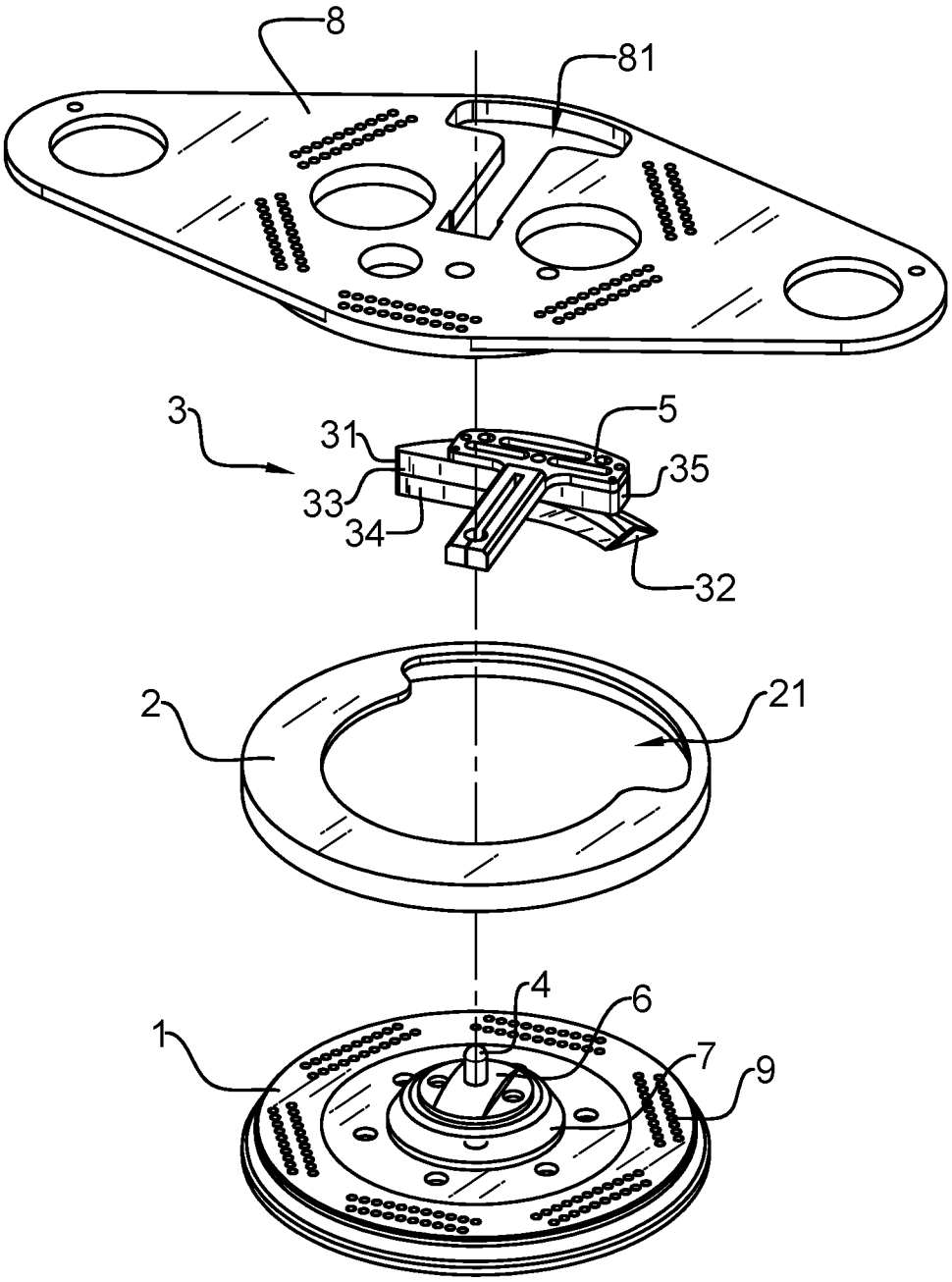
FIG. 3 is an exploded schematic diagram of a uniform-distribution filling mechanism for a medicinal powder of the present invention.

Referring to FIG. 1 and FIG. 2, an uniform-distribution filling mechanism for a medicinal powder of the present invention for a capsule filling machine includes a metering disk 1, a powder storage ring 2 (forming a storage) and a lateral powder blocker 3. One end of the lateral powder blocker 3 has a pointed tip 31 and the other end of the lateral powder blocker 3 has a (slant) downhill sloping stage 32. A middle part of the metering disk 1 has a support shaft 4 mounted thereon, and the support shaft 4 is connected to the lateral powder blocker 3 through a support arm 5 (the support arm 5 is T-shaped).

Among these, the lateral powder blocker 3 is on a side of the metering disk 1 while the support arm 5 is on top of the lateral powder blocker 3 and the support shaft 4 is connected to the index turning mechanism (at the bottom of the metering disk) of the capsule filling machine, wherein the support arm 5 is mounted in a guide plate 8 which is installed on top of the powder storage ring 2, so as to prevent the support arm from turning.

The lateral powder blocker 3 can be divided into an upper lateral powder blocker 33 and a lower lateral powder blocker 34 (were set tightly up and down). Each of the same ends of the upper lateral powder blocker 33 and the lower lateral powder blocker 34 has a pointed tip 31 for the same (direction). The other end of the upper lateral powder blocker 33 is a flat head 35, while the other end of the lower lateral powder blocker 34 is split into two heads, each of which having a downhill sloping stage 34.

In order for the medicinal powder to distribute more uniformly on the metering disk, and to avoid powder leakage, there is a bearing housing 6 (including bearing) embracing the periphery of the support shaft 4 and on the metering disk 1. Besides, there is a middle powder blocker 7 surrounding at the periphery of the bearing housing 6 and on the metering disk 1.

Operating principles of the present invention are that: because the support arm 5 is stuck in the guide plate 8, the support arm cannot rotate, and both the lateral powder blocker 3 and the support shaft 4 do not rotate either, wherein the metering disk 1, the bearing housing 6, and the middle powder blocker 7 are driven by the index turning mechanism and conduct intermittent rotation simultaneously.

As shown in FIG. 1 and FIG. 2, on the metering disk 1, there are several sets of medicinal powder holes 9 which can be divided into four groups (group A, B, C, and D) of stamping column shaped medicinal powder holes and one group (group E) of medicinal powder holes for filling (they can switch when the metering disk rotates).

The mass of medicinal powder in the metering disk and the powder storage ring will be through the insertion by the pointed tip of the lateral powder blocker and the effect of evenly stirring of the medicinal powder by the lateral powder blocker itself. Then, the medicinal powder will be evenly transferred downward through a downhill form sloping stage of the lateral powder blocker, so that the medicinal powder is able to be evenly transferred and proportionately distributed on the metering disk by entering to right side of the lateral powder blocker and leaving from the side thereof. The medicinal powder, in various sets of medicinal powder holes 9 (consisted of group A, B, C, D, and E), is then progressively stamped for several times by filling sticks of the refilling mechanism of the capsule filling machine, so as to conform the amount of medicinal powder in each set of the medicinal powder holes on the metering disk, which increases the precision. Eventually, the medicinal powder will fill into vacant capsule bodies through the group E medicinal powder hole, which conforms and unifies the filled amount of medicinal powder for each of the capsules and meets the requirements of relative criteria.

It is worth mentioning that, as shown FIG. 1 and FIG. 2, the uniform-distribution filling mechanism for a medicinal powder, which is used in the capsule filling machine including the metering disk 1, the powder storage ring 2, the lateral powder blocker 3, and other necessary elements. The powder storage ring 2 has a containing chamber 21 for storing medicinal powder for subsequently filling into capsules. The metering disk 1 is contained in the containing chamber 21. The lateral powder blocker 3 extends from one side of the powder storage ring 2 to another side thereof. More particularly, the lateral powder blocker 3 is axially connected to the metering disk 1 and the lateral powder blocker 3 extends from the side of powder storage ring 2 that is close to the metering disk 1 to the other side. Further, the lateral powder blocker 3 is able to be subsequently axially connected to a main driving part 100, so as to be driven by the main driving part 100 to conduct circular movement relative to the metering disk 1, and therefore to implement filling for the medicinal powder stored in the powder storage ring 2.

It is worth mentioning that the main driving part 100 is preferably a stepper motor, and characteristics of stepper motor, such as motion time and motion frequency, can all be designed and adjusted according to various using needs, so as to better fill the medicinal powder in the capsule and for ease of use.

Figure 4:
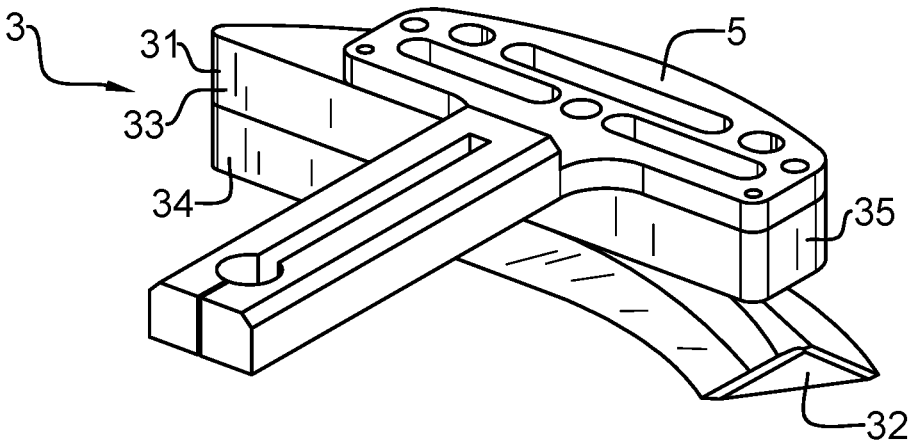
FIG. 4 is perspective view of an embodiment of a lateral powder blocker of the present invention.

More particularly, in some embodiments of the present invention, as shown FIG. 4, the lateral powder blocker 3 has the pointed tip 31 and the sloping stage 32. The pointed tip 31 and the sloping stage 32 are respectively provided at two sides of the lateral powder blocker 3. When the uniform-distribution filling mechanism for medicinal powder is used for implementing medicinal powder filling processes, the medicinal powder stored in the containing chamber 21 will be through the insertion by the pointed tip 31 of the lateral powder blocker 3 and the effect of evenly stirring of the medicinal powder by the lateral powder blocker 3 itself. Then, the medicinal powder will be evenly transferred downward through the sloping stage 32 of the lateral powder blocker 3, so that the medicinal powder is able to enter from the left side of the lateral powder blocker 3 and to leave from the right side thereof. Then the medicinal powder can be evenly transferred and distributed on the metering disk 1.

Preferably, the sloping stage 32 is a downhill form sloping stage, so as to allow medicinal powder to more evenly fill into inside of the capsule.

It is worth mentioning that those skilled in the art should understand that the downhill form sloping stage is only a preferable embodiment for the sloping stage 32, which shall not be used to confine the scope and content of the present invention. Therefore, there still are many other ways to implement the sloping stage 32.

Figure 5:
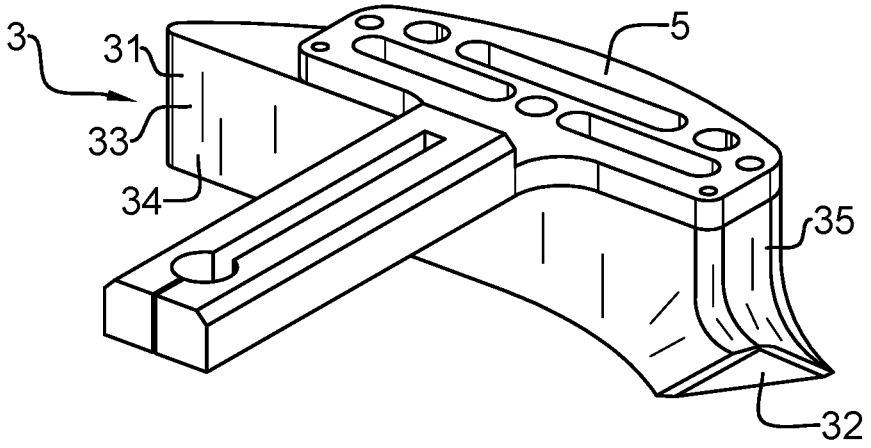
FIG. 5 is perspective view of another embodiment of a lateral powder blocker of the present invention.

In other embodiments of the present invention, like as shown in FIG. 5, the lateral powder blocker 3 includes the upper lateral powder blocker 33 and the lower lateral powder blocker 34, wherein the upper lateral powder blocker 33 and the lower lateral powder blocker 34 are overlappingly set,. Each of the upper lateral powder blocker 33 and the lower lateral powder blocker 34 has the pointed tip 31 at the same side thereof, and the shape and size of the pointed tips 31 are identical, wherein the other end of the upper lateral powder blocker 33 forms the flat head 35 while, correspondingly, the other end of the lower lateral powder blocker 34 forms the sloping stage 34, which means that the flat head 35 and the sloping stage 34 are at the same side.

Figure 6:
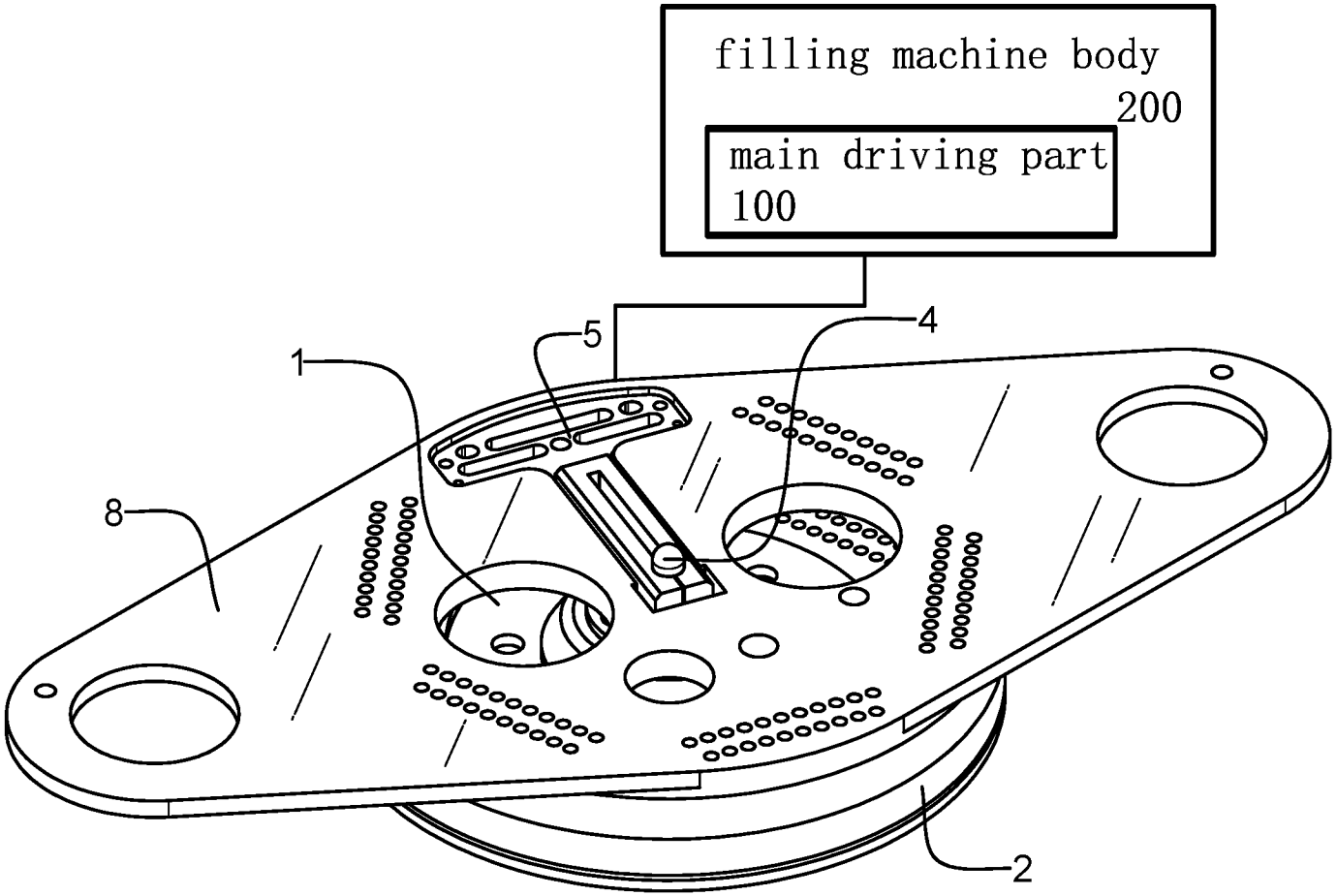
FIG. 6 is a structural schematic diagram of a capsule filling machine.

As shown FIG. 6, the present invention also provides a capsule filling machine, which includes a filling machine body 200 and a uniform-distribution filling mechanism for medicinal powder, wherein the filling machine body 200 also includes a main driving part 100 to subsequently provide driving force for the uniform-distribution filling mechanism for medicinal powder.

It is worth mentioning that the capsule filling machine further includes a guide plate 8, which includes a guide channel 81 so as to allow the support arm 5 to pass through the guide channel 81 to ensure the reliability and stability of the capsule filling machine in use.

Figure 7:
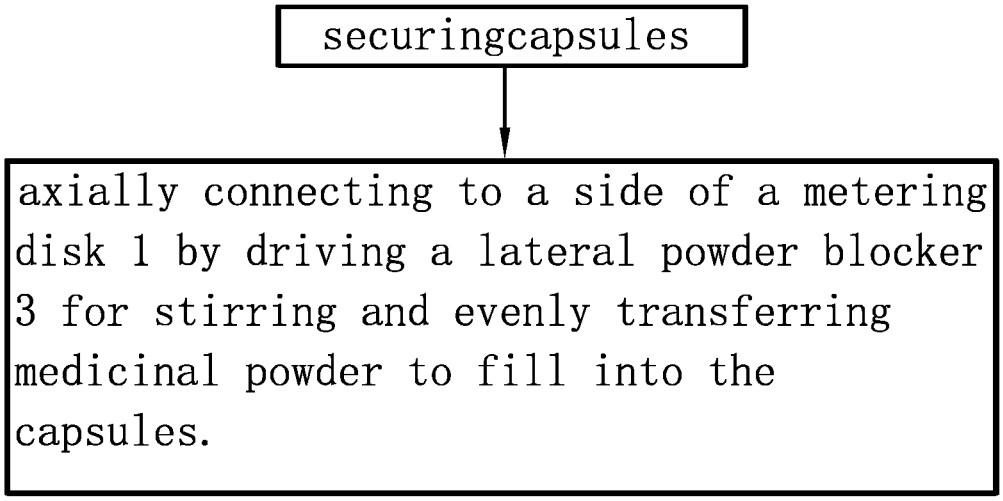
FIG. 7 is a diagram of the processes of the present invention evenly filling medicinal powder into capsules.

As shown FIG. 7, the present invention also provides a method to implement evenly filling medicinal powder into capsules, wherein the method includes the following steps:

(a) securing capsules; and (b) axially connecting to a side of a metering disk 1 by driving a lateral powder blocker 3 for stirring and evenly transferring medicinal powder to fill into the capsules.

Preferably, the step (b) further includes the following steps:

(b.1) axially connecting one the lateral powder blocker 3 to the metering disk 1;

(b.2) providing a powder storage ring 2 for storing medicinal powder, wherein the lateral powder blocker 3 extends from one side of the powder storage ring 2 to another side thereof; and (b.3) driving the lateral powder blocker 3 to move relative to the metering disk 1, to respectively stir and transfer medicinal powder evenly.

What is claimed is:

1. A uniform-distribution filling mechanism for medicinal powder, which is adapted for a capsule filling machine, comprising:

a metering disk;

a powder storage ring having a containing chamber for storing the medicinal powder, wherein said metering disk is contained in said containing chamber; and a lateral powder blocker, wherein said lateral powder blocker extends along said powder storage ring and is axially connected to said metering disk, wherein said lateral powder blocker has a pointed tip and a sloping stage, wherein said pointed tip and said sloping stage are respectively provided at two sides of said lateral powder blocker, wherein said pointed tip is for stirring the medicinal powder evenly and said sloping stage is for uniformly distributing medicinal powder on said metering disk.

2. The uniform-distribution filling mechanism, as recited in claim 1, further comprising a support arm and a support shaft, wherein said support shaft is axially connected to the metering disk, wherein two ends of said support arm are respectively connected to said support shaft and said lateral powder blocker, so as to allow said lateral powder blocker to use said support shaft as an axis to conduct rotational movement toward said metering disk.

3. The uniform-distribution filling mechanism, as recited in claim 2, further comprising a bearing housing set at said metering disk, wherein said support shaft is set and axially connected to said bearing housing.

4. The uniform-distribution filling mechanism, as recited in claim 3, further comprising a middle powder blocker set at said bearing housing.

5. A uniform-distribution filling mechanism for medicinal powder, which is adapted for a capsule filling machine, comprising:

a metering disk;

a powder storage ring having a containing chamber for storing the medicinal powder, wherein said metering disk is contained in said containing chamber; and a lateral powder blocker, wherein said lateral powder blocker extends along said powder storage ring and is axially connected to said metering disk, wherein said lateral powder blocker comprises an upper lateral powder blocker and a lower lateral powder blocker overlappingly set at said upper lateral powder blocker, wherein each of said upper lateral powder blocker and said lower lateral powder blocker has a pointed tip at the same side thereof, wherein the other end of said upper lateral powder blocker forms a platform and the other end of said lower lateral powder blocker correspondingly forms a sloping stage.

6. The uniform-distribution filling mechanism, as recited in claim 5, wherein said sloping stage is a downhill form sloping stage.

7. The uniform-distribution filling mechanism, as recited in claim 5, further comprising a support arm and a support shaft, wherein said support shaft is axially connected to the metering disk, wherein two ends of said support arm are respectively connected to said support shaft and said lateral powder blocker, so as to allow said lateral powder blocker to use said support shaft as an axis to conduct rotational movement toward said metering disk.

8. The uniform-distribution filling mechanism, as recited in claim 7, further comprising a bearing housing set at said metering disk, wherein said support shaft is set and axially connected to said bearing housing.

9. The uniform-distribution filling mechanism, as recited in claim 8, further comprising a middle powder blocker set at said bearing housing.

10. A uniform-distribution filling mechanism for medicinal powder, which is adapted for a capsule filling machine, comprising:

a metering disk;

a powder storage ring having a containing chamber for storing the medicinal powder, wherein said metering disk is contained in said containing chamber;

a lateral powder blocker, wherein said lateral powder blocker extends along said powder storage ring and is axially connected to said metering disk; and a support arm and a support shaft, wherein said support shaft is axially connected to the metering disk, wherein two ends of said support arm are respectively connected to said support shaft and said lateral powder blocker, so as to allow said lateral powder blocker to use said support shaft as an axis to conduct rotational movement toward said metering disk.

11. The uniform-distribution filling mechanism, as recited in claim 10, further comprising a bearing housing set at said metering disk, wherein said support shaft is set and axially connected to said bearing housing.

12. The uniform-distribution filling mechanism, as recited in claim 11, further comprising a middle powder blocker set at said bearing housing.

13. A capsule filling machine, comprising:

a filling machine body, which includes a main driving part; and a uniform-distribution filling mechanism for medicinal powder, which comprises:

a metering disk;

a powder storage ring having a containing chamber for storing the medicinal powder, wherein said metering disk is contained in said containing chamber; and a lateral powder blocker, wherein said lateral powder blocker extends along said powder storage ring and is axially connected to said metering disk, wherein said lateral powder blocker is coupled to said main driving part, so as to synchronize with the movement of said main driving part, wherein said lateral powder blocker has a pointed tip adapted for stirring the medicinal powder evenly and a sloping stage adapted for uniformly distributing the medicinal powder on said metering disk, wherein said pointed tip and said sloping stage are respectively provided at two sides of said lateral powder blocker, wherein said pointed tip is arranged for stirring the medicinal powder evenly.

14. A capsule filling machine, comprising:

a filling machine body, which includes a main driving part; and a uniform-distribution filling mechanism for medicinal powder, which comprises:

a metering disk;

a powder storage ring having a containing chamber for storing the medicinal powder, wherein said metering disk is contained in said containing chamber; and a lateral powder blocker, wherein said lateral powder blocker extends along said powder storage ring and is axially connected to said metering disk, wherein said lateral powder blocker is coupled to said main driving part, so as to synchronize with the movement of said main driving part, wherein said lateral powder blocker comprises an upper lateral powder blocker, and a lower lateral powder blocker overlappingly set at said upper lateral powder blocker, wherein each of said upper lateral powder blocker and said lower lateral powder blocker has a pointed tip at the same side thereof, wherein the other end of said upper lateral powder blocker forms a platform and the other end of said lower lateral powder blocker correspondingly forms a sloping stage.

15. The capsule filling machine, as recited in claim 14, wherein said sloping stage is a downhill form sloping stage.

16. The capsule filling machine, as recited in claim 14, further comprising a support arm and a support shaft, wherein said support shaft is axially connected to the metering disk, wherein two ends of said support arm are respectively connect to said support shaft and said lateral powder blocker, so as to allow said lateral powder blocker to use said support shaft as an axis to conduct a rotational movement toward said metering disk.

17. The capsule filling machine, as recited in claim 15, further comprising a support arm and a support shaft, wherein said support shaft is axially connected to the metering disk, wherein two ends of said support arm are respectively connect to said support shaft and said lateral powder blocker, so as to allow said lateral powder blocker to use said support shaft as an axis to conduct a rotational movement toward said metering disk.

18. The capsule filling machine, as recited in claim 16, further comprising a bearing housing set at said metering disk, wherein said support shaft is set and axially connected to said bearing housing.

19. The capsule filling machine, as recited in claim 17, further comprising a bearing housing set at said metering disk, wherein said support shaft is set and axially connected to said bearing housing.

20. The capsule filling machine, as recited in claim 18, further comprising a middle powder blocker set at said bearing housing.

21. The capsule filling machine, as recited in claim 19, further comprising a middle powder blocker set at said bearing housing.

22. The capsule filling machine, as recited in claim 16, further comprising a guide plate having a guide channel to allow said support arm to pass through the guide channel.

23. The capsule filling machine, as recited in claim 17, further comprising a guide plate having a guide channel to allow said support arm to pass through the guide channel.

24. A capsule filling machine, comprising:

a filling machine body, which includes a main driving part; and a uniform-distribution filling mechanism for medicinal powder, which further comprises:

a metering disk;

a powder storage ring having a containing chamber for storing the medicinal powder, wherein said metering disk is contained in said containing chamber;

a lateral powder blocker, wherein said lateral powder blocker extends along said powder storage ring and is axially connected to said metering disk, wherein said lateral powder blocker is coupled to said main driving part, so as to synchronize with the movement of said main driving part; and a support arm and a support shaft, wherein said support shaft is axially connected to the metering disk, wherein two ends of said support arm are respectively connect to said support shaft and said lateral powder blocker, so as to allow said lateral powder blocker to use said support shaft as an axis to conduct a rotational movement toward said metering disk.

25. The capsule filling machine, as recited in claim 24, further comprising a bearing housing set at said metering disk, wherein said support shaft is set and axially connected to said bearing housing.

26. The capsule filling machine, as recited in claim 25, further comprising a middle powder blocker set at said bearing housing.

27. The capsule filling machine, as recited in claim 24, further comprising a guide plate having a guide channel to allow said support arm to pass through the guide channel.

28. A method to implement evenly filling medicinal powder into capsules, comprising the following steps:

(a) securing capsules; and (b) axially connecting to a side of a metering disk by driving a lateral powder blocker for stirring and evenly transferring the medicinal powder to fill into the capsules, wherein the step (b) further comprises the following steps:

(b.1) axially connecting the lateral powder blocker to the metering disk;

(b.2) providing a powder storage ring for storing the medicinal powder, wherein the lateral powder blocker extends along the powder storage ring; and (b.3) driving the lateral powder blocker to move relative to the metering disk to respectively stir and transfer the medicinal powder evenly;

wherein said lateral powder blocker has a pointed tip adapted for stirring the medicinal powder evenly and a sloping stage adapted for uniformly distributing the medicinal powder on said metering disk, wherein said pointed tip and said sloping stage are respectively provided at two sides of said lateral powder blocker, wherein said pointed tip is for stirring medicinal powder evenly.

29. The method, as recited in claim 28, wherein said lateral powder blocker comprises an upper lateral powder blocker, and a lower lateral powder blocker overlappingly set at said upper lateral powder blocker, wherein each of said upper lateral powder blocker and said lower lateral powder blocker has a pointed tip at the same side thereof, wherein said other end of said upper lateral powder blocker forms a platform and the other end of said lower lateral powder blocker correspondingly forms a sloping stage.

30. The method, as recited in claim 28, further comprising a support arm and a support shaft, wherein said support shaft axially connects said metering disk, wherein two ends of said support arm are respectively connected to said support shaft and said lateral powder blocker, so as to enable said lateral powder blocker to use said support shaft as an axis to conduct a rotational movement toward said metering disk.

31. The method, as recited in claim 29, further comprising a support arm and a support shaft, wherein said support shaft axially connects said metering disk, wherein two ends of said support arm are respectively connected to said support shaft and said lateral powder blocker, so as to enable said lateral powder blocker to use said support shaft as an axis to conduct a rotational movement toward said metering disk.

32. The method, as recited in claim 30, further comprising a bearing housing set at said metering disk, wherein said support shaft is set and axially connected to said bearing housing.

33. The method, as recited in claim 31, further comprising a bearing housing set at said metering disk, wherein said support shaft is set and axially connected to said bearing housing.

* * * * *